United States Patent [19]

Levy

[11] 3,955,217

[45] May 11, 1976

[54] PERMANENTLY KNOTTED NECKTIE AND METHOD OF MAKING SAME

[76] Inventor: David H. Levy, 65-11 108th St., Forest Hills, N.Y. 11375

[22] Filed: Feb. 26, 1973

[21] Appl. No.: 335,506

Related U.S. Application Data

[63] Continuation-in-part of Ser. No. 297,248, Nov. 13, 1972, abandoned.

[52] U.S. Cl. ..... 2/150

[51] Int. Cl.[2] ..... A41D 25/02

[58] Field of Search ..... 2/150, 153, 155, 144

[56] References Cited

UNITED STATES PATENTS

| | | | |
|---|---|---|---|
| 1,728,599 | 9/1929 | Fiumedoro | 2/155 |
| 2,023,293 | 12/1935 | Sears | 2/155 |
| 2,834,967 | 5/1958 | Taksa | 2/155 |

FOREIGN PATENTS OR APPLICATIONS

| | | | |
|---|---|---|---|
| 555,614 | 3/1957 | Belgium | 2/150 |
| 710,248 | 6/1954 | United Kingdom | 2/150 |

*Primary Examiner*—Patrick D. Lawson
*Attorney, Agent, or Firm*—John B. Dickman, III

[57] ABSTRACT

A permanently knotted necktie comprises an elongated necktie body having a front face and a rear face, a permanent necktie knot and an extensible strap for detachably fastening the necktie around a person's neck. The permanent necktie knot and the necktie body may be formed from a single strip of material or the knot and body may be formed from separate strips of material. In the former case, the knot is formed by folding one end of the strip material back onto the front face of the body and then folding the free ends of the folded-back portion around the body and fastening them together at the rear face. In the latter case, the knot is formed by folding one end of the body strip material back onto the rear face of the body and then encircling the knot strip material around the folded-back portion and fastening together the ends of the knot strip material at the rear face.

8 Claims, 26 Drawing Figures

FIG. 19
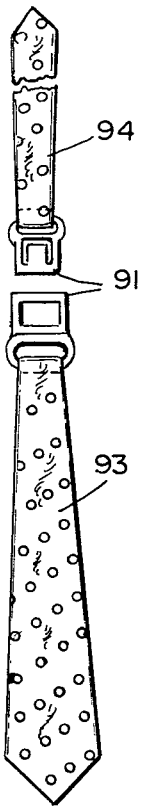
FIG. 20
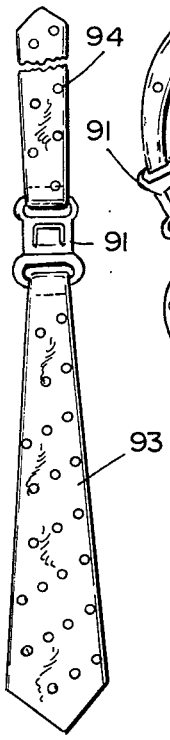
FIG. 21
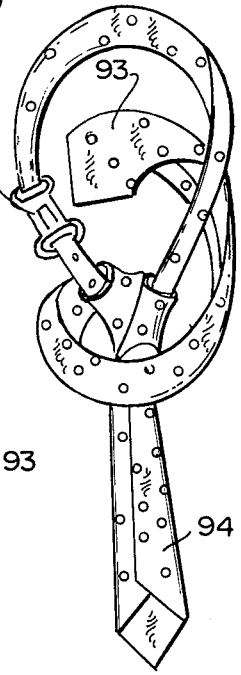
FIG. 22
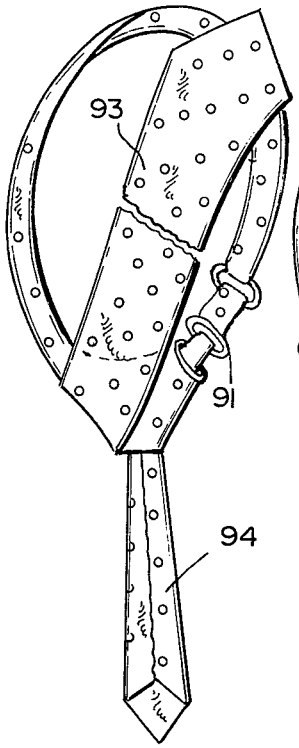
FIG. 23
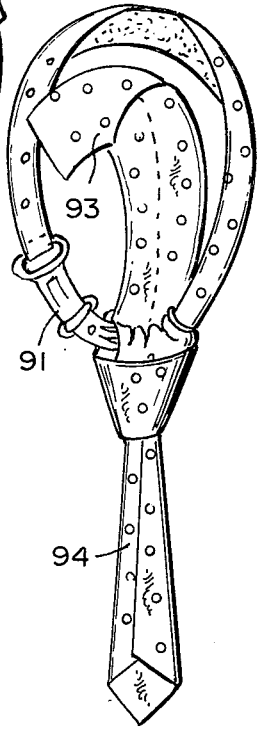
FIG. 24
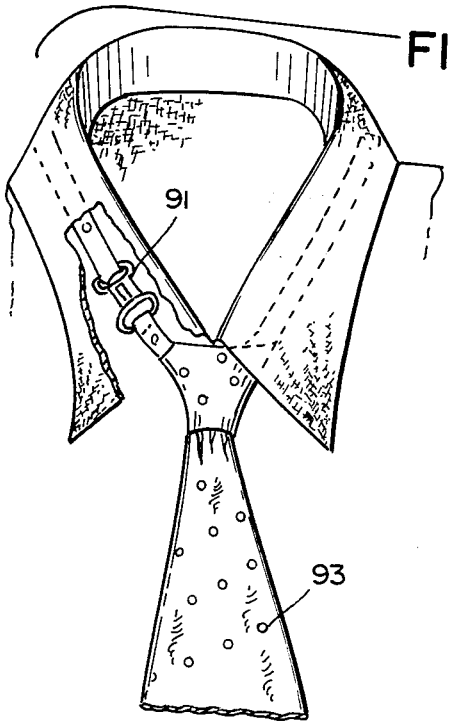
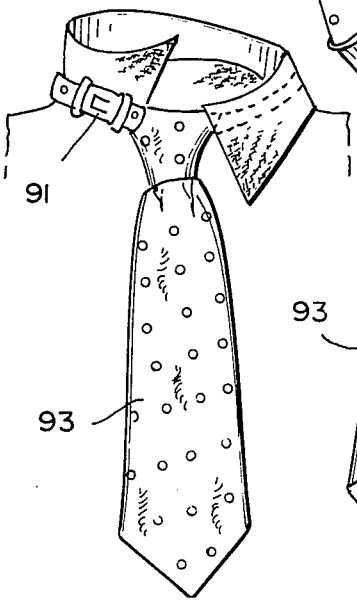
FIG. 25
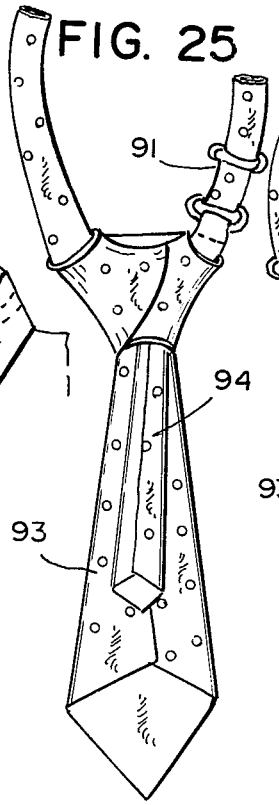
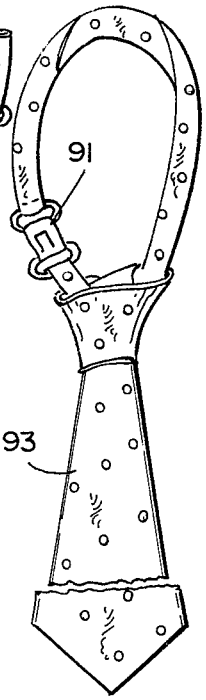
FIG. 26

PERMANENTLY KNOTTED NECKTIE AND METHOD OF MAKING SAME

The present application is a continuation-in-part of U.S. application Ser. No. 297,248 filed Nov. 13, 1972, and now abandoned, by the same applicant.

The present invention pertains generally to a necktie and more particularly to a permanently knotted necktie which is detachably fastened during use around a person's neck.

Many types of neckties are known and most of them require that the necktie be newly knotted during each wearing of the necktie. When the necktie is removed, the knot is untied and this process must be repeated each time the necktie is worn. This is disadvantageous since the necktie material tends to become wrinkled and the necktie soon exhibits a worn appearance despite careful handling by the wearer. In addition, considerable time must be spent in tying the necktie knot and oftentimes more than one tie is necessary to obtain the proper knot configuration or to adjust the lengths of the necktie ends.

It is therefore a primary object of the present invention to provide a permanently knotted necktie having a permanent necktie knot which is never disassembled.

It is a further object of the present invention to provide a permanently knotted necktie which is detachably fastened around the neck of a wearer in a rapid and simple manner.

It is a further object of the present invention to provide a permanently knotted necktie composed of synthetic or natural leather exhibiting a chic appearance and being highly resistant to wrinkling.

Yet another object of the invention is to provide a permanently knotted necktie of textile fabric.

It is a still further object of the present invention to provide a method for making a permanently knotted necktie.

It is another object of the invention to provide an assembly of components for a permanently knotted necktie, such that will enable an individual to assemble a necktie of the above character without any special training, but by means of following simple instructions.

These and other objects are carried out by providing a permanently knotted necktie composed of a main body portion, a permanent knot portion, and fastening means for detachably fastening the necktie around the neck of a wearer. The knot portion and the main body portion may be composed of a single strip of material or the knot portion and the main body portion may each be formed from separate strips of material.

Having in mind the above and other objects that will be evident from an understanding of this disclosure, the present invention comprises the combinations and arrangements of parts as illustrated in the presently preferred embodiments of the invention which are hereinafter set forth in sufficient detail to enable those persons skilled in the art to clearly understand the function, operation, construction and advantages of it when read in conjunction with the accompanying drawing, wherein like characters denote like parts in the various views, and wherein:

FIG. 19, illustrates on a larger scale the necktie shown in FIG. 18, with the connection in unlocked position, FIG. 20 illustrates the necktie shown in FIG. 19, but in locked position, and FIGS. 21–26 illustrate the method of tying the necktie 22.

Figure 1:
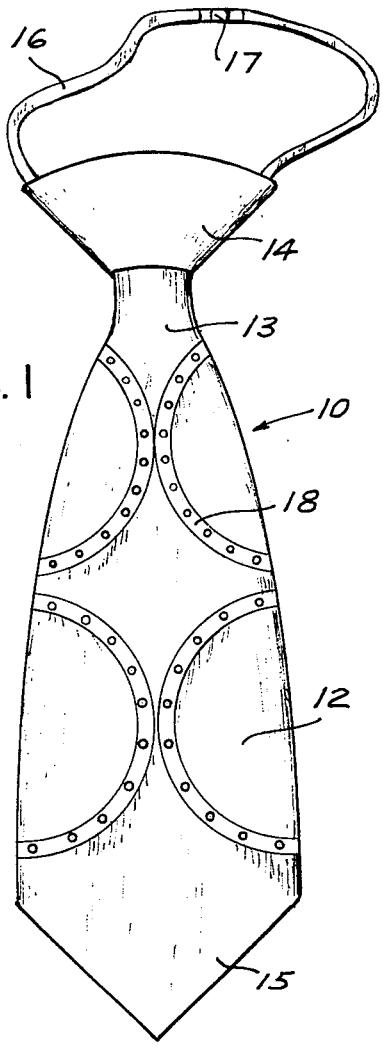
FIG. 1 is a plan front view of one embodiment of necktie according to the present invention.

One embodiment of a permanently knotted necktie constructed in accordance with the principles of the present invention is shown in FIG. 1. The necktie 10 comprises an elongated main body portion 12, a knot portion 14 and fastening means 16, 17 connected to the knot portion to detachably fasten the necktie aroung a person's neck.

The main body portion 12 has a generally flat configuration and terminates at one end in a relatively wide tip section 15 and terminates at the other end in a relatively narrow throat section 13. In the FIG. 1 embodiment, a single strip of material is used to form both the knot portion 14 and the body portion 12 and the necktie has a single-ly construction. The material preferably comprises natural or synthetic leather and a decorative design 18 may be provided on the front face of the body portion 12.

In accordance with the present invention, the knot portion 14 comprises a permanent necktie knot which is never disassembled once the necktie is formed.

The method of making the single strip or single-ply necktie shown in FIG. 1 will now be described with reference to FIGS. 6 – 9.

Figure 7:
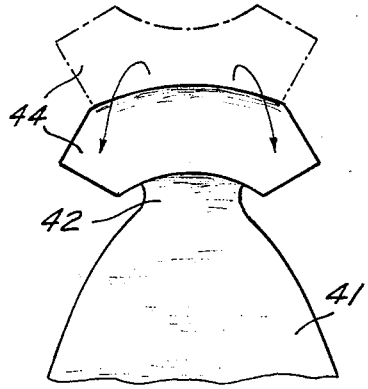

First, a strip of material 41 is provided which is to be formed into the necktie. The strip of material is then shaped into a tie blank 40 having substantially the shape fof the final necktie except for the knot area which has a generally triangular shape 43 with a pair of flaps 44 extending outwardly from two corners of the triangle. The end portion of the tie blank which is to be formed into the knot is then folded back onto the front face of the tie blank as shown in FIG. 7 to form a folded-back portion overlying the front face of the tie body.

Figure 6:
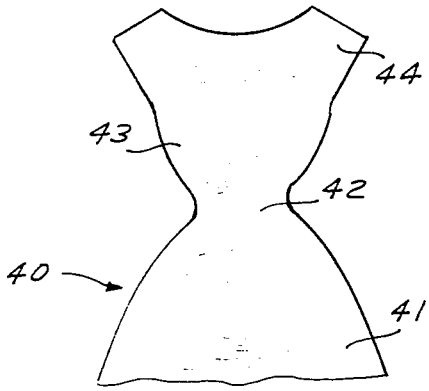
FIGS. 6 – 9 are enlarged explanatory views illustrating another method of forming a permanent necktie knot, shown in FIG. 1, according to the present invention.

Prior to folding back the end portion, a flexible strap 16, partially shown in FIG. 6, is laid on this end portion, whereby it is secured after the knot is completed and appears as shown in dotted lines in FIG. 1.

Figure 8:
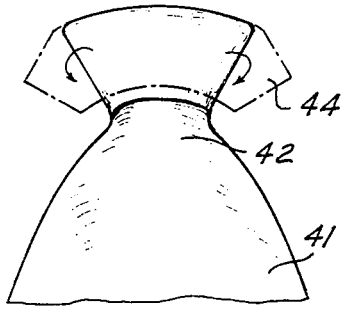
Figure 9:
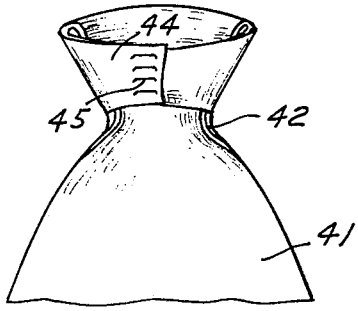

As seen in FIG. 8, the flaps 44 are then folded around behind the tie blank at the throat section 42 and as seen in FIG. 9, the flaps 44 are then fastened together by staples 45 or other suitable fastening means at the rear face of the tie to complete formation of the permanent necktie knot.

Figure 2:
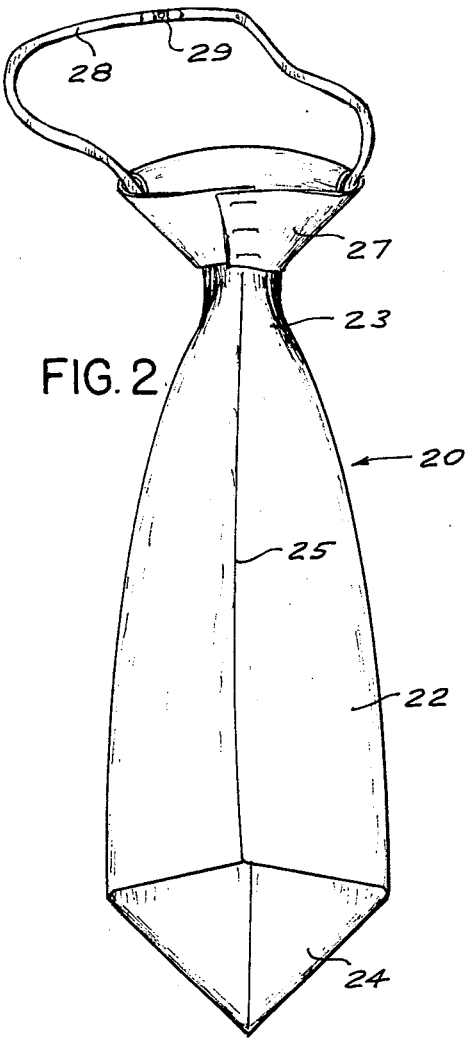
FIG. 2 is a plan rear view of another embodiment of a necktie according to the present invention.

Another embodiment of a permanently knotted necktie constructed in accordance with the principles of the present invention is shown in FIG. 2 and in this embodiment, the necktie 20 is composed of two strips of material. One strip of material is folded back upon itself along two longitudinal fold lines to form an elongated main doby portion 22 having a two-ply or two-layered construction. The main body portion 22 has a planar configuration terminating at the upper end in a narrow throat section 23 and terminating at the lower end in a wide tip section 24. The two folded-back sections of the tie body are sewn together along a longitudinal seam 25.

The permanently knotted necktie 20 further comprises a permanent knot portion 27 attached to the throat section 23 of the main body portion 22. In this embodiment, the knot portion 27 comprises a separate strip of material which encircles the upper end of the throat section 23 to define the necktie knot. Fastening means is connected to the knot portion 27 to removably fasten the necktie around the neck of the wearer. The fastening means comprises a flexible strap 28 connected to the knot portion 27 and a connector assembly 29 affixed to the strap 28 to releasably connect the ends of the strap together.

The method of making the embodiment of necktie shown in FIG. 2 will now be described with reference to FIGS. 3–5. First a strip of material is shaped into a tie blank having substantially the shape of the final necktie except for the knot area. This shaping step includes the step of folding back the strip of material along the two longitudinal fold lines and attaching together the ends of the two folded-back portions along a longitudinal seam such as the seam 25.

Figure 3:
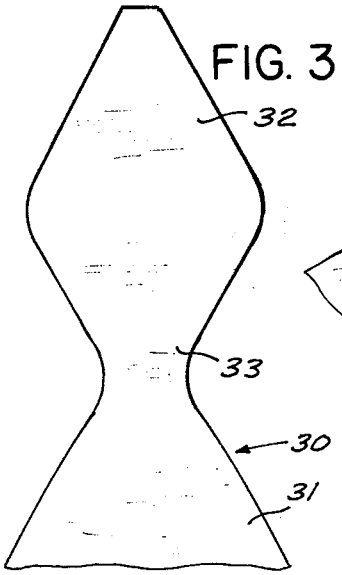
FIGS. 3 – 5 are enlarged explanatory view illustrating the method of forming a permanent necktie knot, shown in FIG. 2, according to the present invention.

FIG. 3 shows the upper portion of a necktie blank 30 formed in the aforementioned manner. The necktie blank 30 has a main body portion 31, a knot area 32 to be formed into the necktie knot, and a throat section 33 interconnecting the main body portion 31 and the knot area 32. A flexible strap 28, partially shown in FIG. 3 is superimposed on the knot area. The knot area 32 of the tie blank 30 is then folded back onto the rear face of the tie blank 30 as depicted in FIG. 4 to form a folded-back portion. A strip of knot material 34 is then encircled once around the folded-back portion and the ends of the strip of knot material are fastened together at the rear face of the tie blank to form the permanent necktie knot. Suitable fastening means such as clips 36 may be used to fasten together the ends of the strip 34 and the ends may be sewn or otherwise bonded together.

Figure 10:
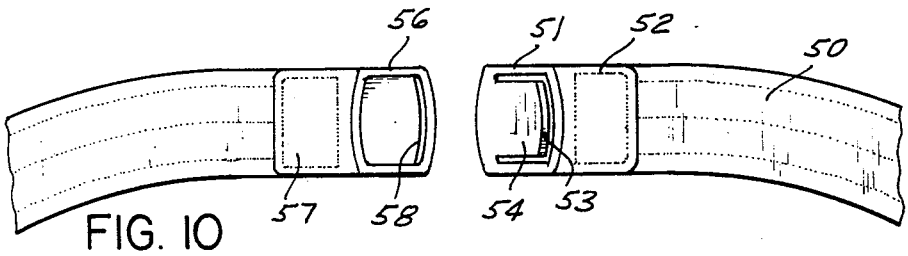
FIGS. 10 – 11 are top and side views, respectively, of a connector device used with the necktie of the present invention.
Figure 11:
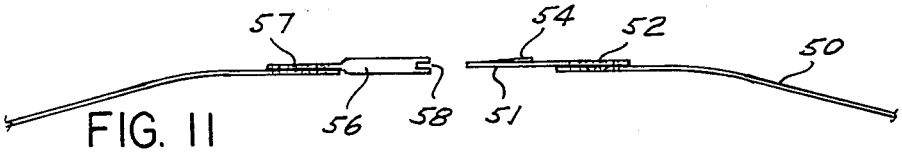

One type of connector assembly which may be used to releasably connect together the ends of the flexibly extensible strap is shown in FIGS. 10 and 11. The connector assembly comprises male and female members connected to the free ends of a flexible strap 50 to enable the ends of the strap to be easily and rapidly connected and disconnected to facilitate donning of the necktie.

The male member is connected to one of the free ends of the flexible strap 50 and the male member comprises a flat plastic element 51 affixed to the end of the strap 50 by a sewing thread 52. The thread 52 is sewn through both the plastic element 51 and the strap 50. The male member includes a flexible projection 54 projecting outwardly from the plastic element 51 in such a manner that the projection may be flexibly moved into and out of the plane of the flat plastic element 51. A slit 53 extends aroung a major portion of the projection 54 to permit the projection to undergo flexure relative to the plastic element 51. The male member is composed of suitable plastic material having sufficient resiliency to permit the projection 54 to repeatedly flex without rupturing.

The female member is connected to the other of the free ends of the strap 50 and comprises a housing 56 having connected therefo a flat portion 57. The flat portion 57 is sewn to the strap 50 in a manner similar to the attachment of the male member to the strap. The housing 56 is provided with an opening 58 for receiving therein the projection 54. As seen in FIG. 10, the upper portion of the housing 56 is provided with a cut-out area dimensioned to receive therein the projection 54 and by such a construction, the projection 54 may be inserted into the housing to an extent far enough that the projection 54 flexes outwardly into the cut-out area.

To use the connector assembly, the male member is inserted into the female member and during this insertion, the projection 54 is flexed downwardly to lie flush with the plane of the plastic element 51. As soon as the projection 54 clears the cut-out area provided in the housing 58, the projection flexes upwardly and engages with the housing thereby forming a releasable connection. To disconnect the connector assembly, the projection 54 is manually depressed into the housing 58 and flush with the plane of the element 51 and then retracted from the housing.

The invention has been described in conjunction with preferred embodiments and it is to be understood that obvious modifications and changes may be made without departing from the spirit and scope of the invention as defined in the appended claims.

Figure 12:
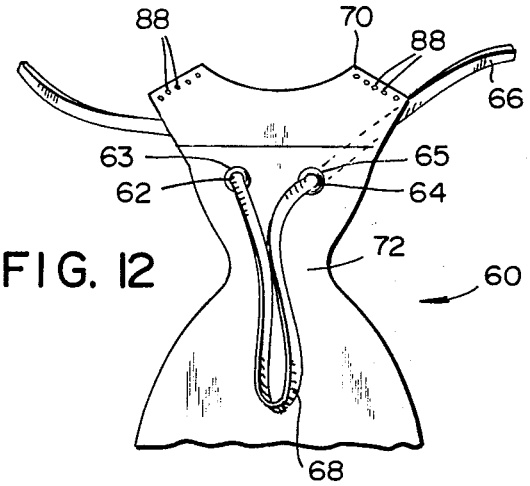
FIGS. 12 – 15 illustrate the method of making another embodiment of a one-piece necktie according to the invention.

An important novel construction of the permanently knotted necktie is shown in FIG. 12.

Figure 13:
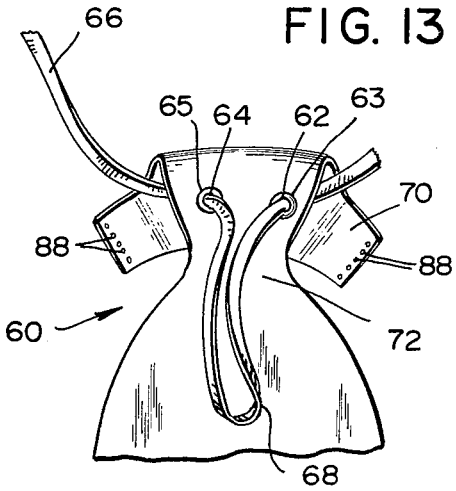

As can be seen in these Figures, a one-piece generally triangular necktie blank 60, shaped similarly to blank 40, is formed with a pair of spaced holes 62, 64, reinforced with grommets 63, 65. A flexible strap 66 of synthetic or natural leather to serve as a neckband, is passed through the holes 62, 64 and the blank 60 and formed into a loop 68 in the manner shown in FIG. 12. The end portion of the tie blank which is to be formed into the knot is then folded back onto the front face of the tie blank, as shown in FIG. 13. The pair of flaps 70, extending from the blank 60 are next folded around behind the tie blank and over the strap 66, at the throat 72 and fastened together by staples 74. Finally the male and female members of the connector assembly 67, as previously described and illustrated in FIGS. 10 and 11 are secured to the respective ends of the strap 66. Due to the friction resulting between the strap 66 and the edges of holes 62, 64 the necktie knot portion 76 of necktie 77 will not slide and will not be displaced on the strap without considerable effort and remain in the position set by the wearer.

To adjust the strap 66 for different neck sizes, it is merely necessary to pull on the strap ends or on the loop 68, depending on the neck size of the wearer.

Figure 4:
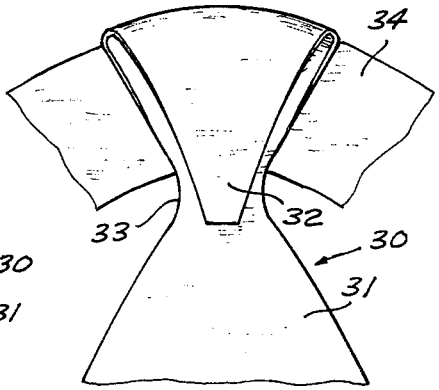
Figure 5:
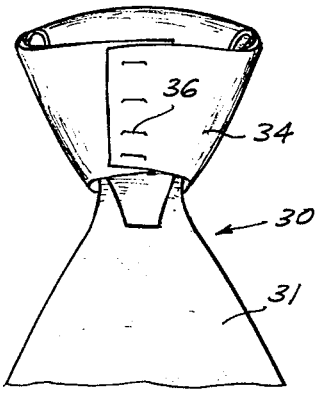
Figure 14:
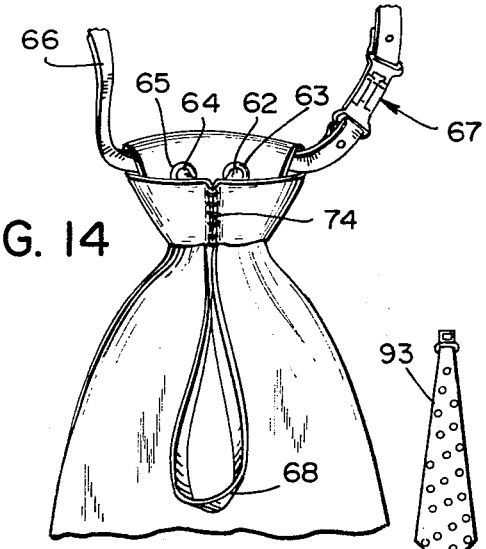
Figure 15:
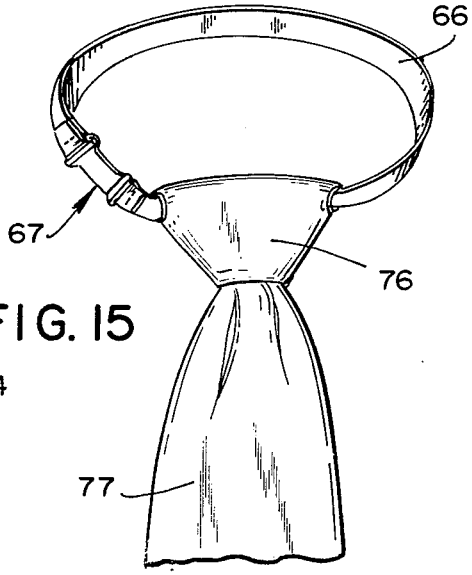
Figure 16:
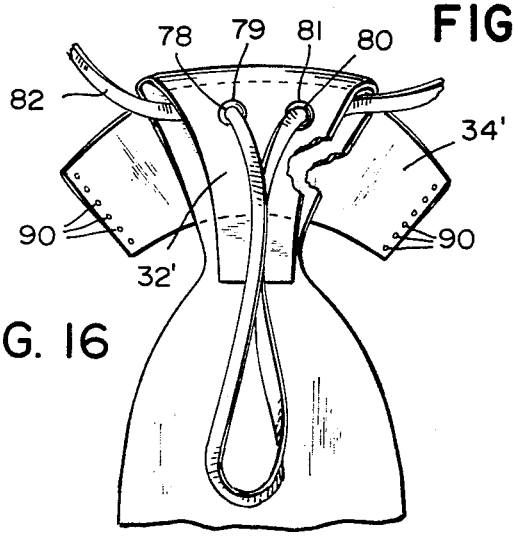
FIG. 16 illustrates the method of making another embodiment of a two-piece necktie according to the invention

A similar construction is employed with a two-piece permanently knotted necktie of the type shown in FIGS. 3–5. Holes 78, 80 and grommets 79, 81 are provided in the knot area 32, (FIG. 16). A flexible synthetic or natural leather strap 82 is threaded through holes 78, 80. The area portion 32′ is folded over the strap 82. A strip of knot material 34′ is then encircled once around the folded-back portion and the ends of the strip of knot material 34' are fastened together to form the permanent necktie knot in the same manner shown in FIG. 14. The connector assembly shown in FIGS. 10–11 is next secured to the strap ends. The size of the thus formed neck band is adjusted in the same manner described in connection with the above-described one-piece construction.

As previously noted, the permanently knotted tie according to the invention lends itself to the so-called "do-it-yourself" assembly. The construction in each of the above described modification is the same, except that edge holes such as 84 (FIGS. 3–5), 86 (FIGS. 6–8) 88, 90 (FIGS. 12–16) are provided, so that a needle and thread may pass therethrough to join the respective flaps, thus making it possible to assemble the neckties without any special instruments.

Figure 17:
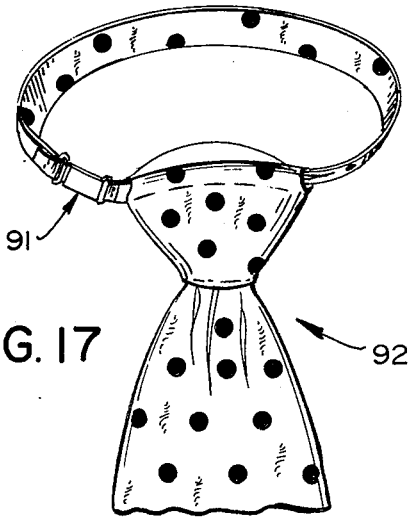
FIG. 17 illustrates an embodiment according to the invention, employing a textile fabric.

The invention is not limited to the use of synthetic or natural leather, but may be practiced with textile fabrics. An example of a permanently knotted necktie 92 of that type, employing the connector assembly 91 of the type shown in FIGS. 10 – 11, is illustrated in FIG. 17.

Figure 18:
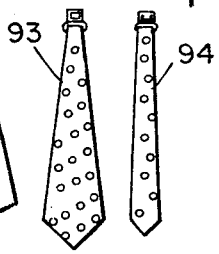

The permanently knotted necktie 92, may also serve as a non-permanent necktie, by unlocking the connextor assembly 91 and untying the tie knot in the usual manner. The untied parts 93, 94 are illustrated in FIG. 18.

I claim:

1. A permanently knotted necktie comprising: an elongated planar body portion having a front face visible during wearing of the necktie, a rear face not visible during wearing of the necktie, and two ends; a knot portion connected to one of said ends of said body portion comprising a strip encircling once said one end to define therewith a permanent necktie knot, one end of said body portion has an end flap folded back upon itself to define a folded-back portion; and wherein said single strip of said knot portion encircles said folded-back portion to define therewith said permanent necktie knot, said end flap being provided with a pair of spaced holes having fastening means and wherein said fastening means is a strap of flexible material extending through said holes in frictional engagement therewith and extending between the folds of said folded back portion, said strap having a loop portion and two free ends; and a one hand operated connector assembly connected to said two free ends for quickly, releasably connecting same together, said strap being adapted to extend resiliently around the neck of the user and being adjustable by sliding said strap through said holes, and connecting means connecting together the ends of said strip at the rear face of said body portion; and fastening means connected to said knot portion for quickly and detachably fastening the necktie during use around the neck of a wearer.

2. A necktie as set forth in claim 1, in which said end flap has at least one hole therein.

3. A permanently knotted necktie according to claim 1; wherein said body portion and said knot portion comprise two separate pieces of material respectively configured into said body and knot.

4. A permanently knotted necktie according to claim 1, wherein said body portion and said knot portion comprise two separate pieces of material respectively configured into said body and knot portions, one piece of said material having an endmost portion folded upon itself and provided with a pair of spaced holes, a strap of flexible material extending through said holes in frictional engagement therewith and positioned in said folded endmost portion, said strap having a loop portion and two free ends; and a one hand operated connector assembly connected to said two free ends for quickly releasably connecting the same together, said strap being adjustable by sliding same through said holes.

5. A permanently knotted necktie according to claim 1; wherein said body portion and said knot portion are composed leather and fabric.

6. A permanently knotted necktie according to claim 1; wherein said fastening means comprises a resilient strap connected to said knot portion and having two free ends and resiliently extensible during use to fit around the neck of the wearer, and a one handed, quickly detachable connector assembly connected to said two free ends for releasably connecting same together.

7. A permanently knotted necktie according to claim 1; wherein said connector assembly comprises a female member connected to one of said free ends and having means therein defining an opening, and a male member connected to the other of said free ends and having a projection insertable into and releasably engageable with said opening to effect quick releasable connection of said male and female members.

8. A necktie as claimed in claim 7, adapted for use as a permanent and non-permanent necktie, further comprising two separate pieces of flexible material, said body planar portion having a narrow end secured to said female member, said other piece having one end secured to said male member of said connector assembly.

* * * * *